US010723613B2

(12) United States Patent
Guan

(10) Patent No.: US 10,723,613 B2
(45) Date of Patent: Jul. 28, 2020

(54) DEVICE FOR EXTRACTING LIQUID FROM A CONTAINER

(71) Applicant: SHIMADZU CORPORATION, Kyoto-shi, Kyoto (JP)

(72) Inventor: Enjun Guan, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/291,634

(22) Filed: Mar. 4, 2019

(65) Prior Publication Data

US 2019/0270633 A1 Sep. 5, 2019

(30) Foreign Application Priority Data

Mar. 2, 2018 (CN) ..... 2018 1 0174271

(51) Int. Cl.
*B67D 7/38* (2010.01)

(52) U.S. Cl.
CPC ..... *B67D 7/38* (2013.01)

(58) Field of Classification Search
CPC ..... B67D 7/38; B67D 2001/0824; B67D 2001/0825; B67D 1/0802; B67D 3/0064; B05B 15/30; B05B 15/33; B65D 83/32; B65D 2588/545
USPC ..... 222/464.4
See application file for complete search history.

(56) References Cited

U.S. PATENT DOCUMENTS 3,194,450 A * 7/1965 Van Brocklin ..... B65D 83/36 222/402.1
3,558,020 A * 1/1971 Russell ..... A47G 19/2266 222/416
3,726,443 A * 4/1973 Harris ..... B05B 1/18 222/333
5,323,938 A * 6/1994 Ceccarelli ..... G01F 11/261 222/442
5,366,108 A * 11/1994 Darling ..... F41B 9/0009 222/1
5,376,272 A * 12/1994 Spearman ..... B01D 35/02 210/463
5,529,244 A * 6/1996 Horvath, Jr. ..... A01C 23/042 239/318

(Continued)

*Primary Examiner* — Benjamin R Shaw
(74) *Attorney, Agent, or Firm* — Sughrue Mion, PLLC

(57) ABSTRACT

The present application relates to a device for extracting liquid from a container. The device includes: an extracting unit for extracting the liquid from the container; a hose, where one end of the hose is connected to the extracting unit through a penetration hole formed on a container cover of the container; and a fixing block, including a through hole, where the through hole is connected to the other end of the hose; and one or more abutting members, where one end of the abutting member abuts against the container cover, the other end abuts against the fixing block, and the fixing block abuts against the inner bottom of the container with the through hole facing the inner bottom of the container. The fixing block includes a communicating portion formed on its surface that is opposite to a surface to which the hose is connected, and the through hole of the fixing block is in communicating with the fluid in the container through the communicating portion. According to the present invention, the fixing block can be abutted against the bottom of the container, so that the liquid in the container can be fully extracted.

4 Claims, 2 Drawing Sheets

(56) References Cited

U.S. PATENT DOCUMENTS

| | | | | |
|---|---|---|---|---|
| 5,769,284 | A * | 6/1998 | Vargas | B67D 7/0277 222/464.4 |
| 6,227,412 | B1 * | 5/2001 | Sweeton | B05B 15/00 222/189.1 |
| 7,296,590 | B2 * | 11/2007 | Kitagawa | B01L 3/0293 137/398 |
| 8,201,587 | B2 * | 6/2012 | Bonner | F04B 23/06 141/59 |
| 2001/0002676 | A1 * | 6/2001 | Woods | B65D 83/32 222/402.1 |
| 2001/0030201 | A1 * | 10/2001 | Gerhardt | B67D 1/0004 222/333 |
| 2010/0140303 | A1 * | 6/2010 | Baglin | B05B 11/0059 222/464.4 |
| 2010/0252136 | A1 * | 10/2010 | Koch | F04D 29/708 138/109 |
| 2014/0158720 | A1 * | 6/2014 | Lansky | B05B 11/0059 222/464.4 |
| 2015/0306619 | A1 * | 10/2015 | Snyder | B05B 15/33 222/464.4 |

* cited by examiner

DEVICE FOR EXTRACTING LIQUID FROM A CONTAINER

TECHNICAL FIELD

The present disclosure relates to a device for extracting liquid from a container.

BACKGROUND

Generally, when liquid is extracted from a bottle, a hose is directly inserted into the bottle from the outside of the bottle for extraction. However, if the hose is not fixed, the hose may bend upward. Consequently, when the amount of the remaining liquid is small, the liquid at the bottom of the bottle cannot be normally extracted.

Currently, there is a technical solution in which a fixing block is attached to a hose, so that the hose is fixed to the bottom of the bottle. However, if the liquid is corrosive, a corrosion-resistant material has to be used for the fixing block. Usually, materials such as PTFE, PEEK, and PP are used, and PP is widely used because of its low price. However, the density of these materials, especially the PP material, is quite low. When the density of the liquid is high, the fixing block made of these materials floats and cannot be fixed to the bottom of the bottle. Therefore, the liquid at the bottom of the bottle cannot be fully extracted.

SUMMARY

The Problem to be Solved by the Present Disclosure

The present disclosure has been made to solve the above problem, and an object of the present disclosure is that liquid at the bottom of a container can be fully extracted by using a fixing block regardless of the density of the liquid.

Technical Means for Solving the Problem

According to the present disclosure, a device for extracting liquid from a container includes: an extracting unit configured to extract the liquid from the container, the container having a container cover; a hose, where on end of the hose is connected to the extracting unit through a penetration hole formed on the container cover; and a fixing block, including a through hole, where the through hole is connected to the other end of the hose; an abutting member, where one end of the abutting member abuts against the container cover, the other end abuts against the fixing block, and the fixing block abuts against the inner bottom of the container with the through hole facing the inner bottom of the container. A communication portion is formed on a surface that is of the fixing block and that is opposite to a surface to which the hose is connected, and the through hole of the fixing block is in communication with the fluid in the container through the communication portion.

Effects of the Disclosure

According to the present disclosure, the fixing block can be abutted against the bottom of a container, so that the liquid in the container can be fully extracted.

DESCRIPTION OF EMBODIMENTS

Figure 1:
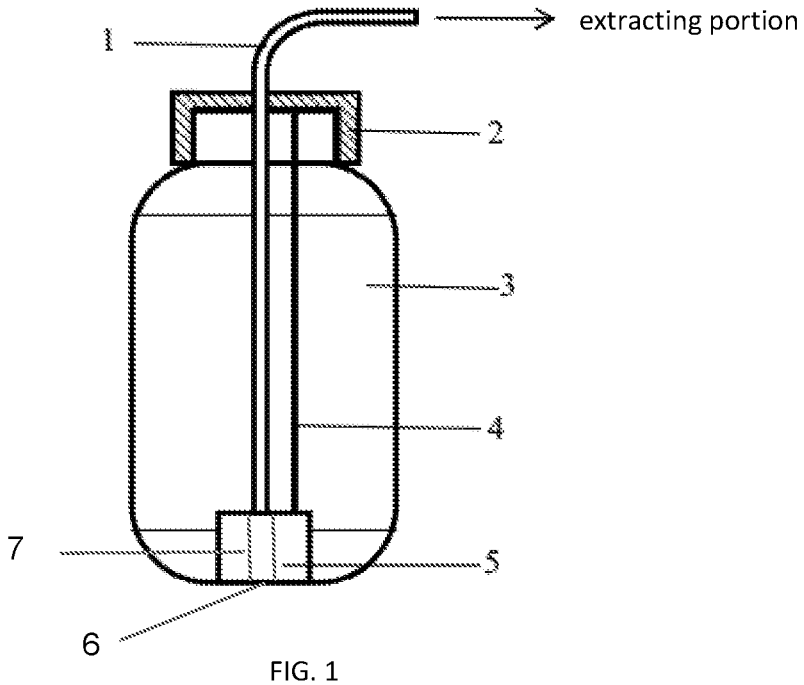
FIG. 1 is a configuration diagram of an embodiment of the present disclosure.

Referring to the drawings, embodiments of the present disclosure are described below.

FIG. 1 is a configuration diagram of an embodiment of the present disclosure.

As shown in FIG. 1, according to the present disclosure, a device for extracting liquid from a container includes a hose 1, an abutting member 4, a fixing block 5, and an extracting unit (not shown). One end of the hose 1 passed through a penetration hole on a container cover 2 of the container 3 is connected to the extracting unit, and the other end is connected to the fixing block 5. In addition, one end of the abutting member 4 abuts against the container cover 2, and the other end abuts against the fixing block 5, so that the fixing block 5 abuts against the bottom of the container 3. With such configuration, the liquid in the container 3 can be extracted by the extracting unit via the hose 1 and the fixing block 5. In addition, regardless of whether the density of the liquid is higher than that of the fixing block 5, the fixing block 5 can be fixed to the bottom of the container 3, so that the liquid at the bottom of the container can be fully extracted.

The extracting unit is configured to extract liquid from the container 3, and a conventional extracting device such as a pump, a syringe can be used. Further, in the case when the liquid is corrosive, the extracting unit is consequently to have corrosion resistance.

The hose 1 is a hose commonly used in the art with no particular requirement for its material. The hose 1 is consequently to have corrosion resistance as long as the liquid is corrosive.

A conventional fixing block in the art can be used as the fixing block 5. The fixing block includes a through hole 7, and the hose 1 is connected to one end of the through hole. The fixing block includes a communicating portion, such as a recess 6, is formed on the bottom surface of the fixing block (i.e., a surface opposite to the surface to which the hose 1 is connected), and the through hole of the fixing block is in communication with the fluid in the container 3 through the communicating portion. In addition, regarding the manner of connecting the hose 1 to the fixing block 5, for example, the hose 1 may be engaged in the through hole of the fixing block 5; or the hose 1 may be engaged with the outer peripheral surface of one end of a connecting member, and the other end of the connecting member is engaged in the through hole of the fixing block 5; or the hose 1 is engaged with the outer peripheral surface of one end of the connecting member, and the other end of the connecting member is screwed with the through hole of the fixing block 5, etc. Apparently, the connecting member described herein has a penetration hole, so that a flow path of the liquid can be formed after the hose 1 is connected to the fixed block 5. In addition, in a case when the liquid is corrosive, the fixing block 5 is made of a material such as PTFE (polytetrafluoroethylene), PEEK (polyether ether ketone), or PP (polypropylene) having corrosion resistance, and is preferably made of a PP material.

The abutting member 4 may have a length that one end abuts against the container cover 2 and the other end abuts against the fixing block 5, and has bending strength that causes the fixing block 5 to abut against the bottom of the container 3. There is no particular limitation on the shape and material of the abutting member 4. In addition, in a case when the liquid is corrosive, the abutting member 4 is consequently to have corrosion resistance. Furthermore, the abutting member 4 may only abut against the fixed block 5 without being connected to the fixing block 5. Alternatively, the abutting member may abut against the fixing block 5 by being connected to the fixing block 5 in a connection manner such as screwing and engaging. Alternatively, the abutting member 4 and the fixing block 5 may be integrally formed to abut against the fixed block 5, and in this case, it is preferable that the abutting member 4 and the fixed block 5 are made of the same material. Further, although only one abutting member 4 is shown in FIG. 1, a plurality of abutting members 4 may be disposed to more reliably abut the fixing block 5 at the bottom of the container 3.

According to this embodiment, the fixing block 5 can be abutted against the inside bottom of the container 3 by using the abutting member 4, so that the liquid in the container 3 can be fully extracted.

Figure 2:
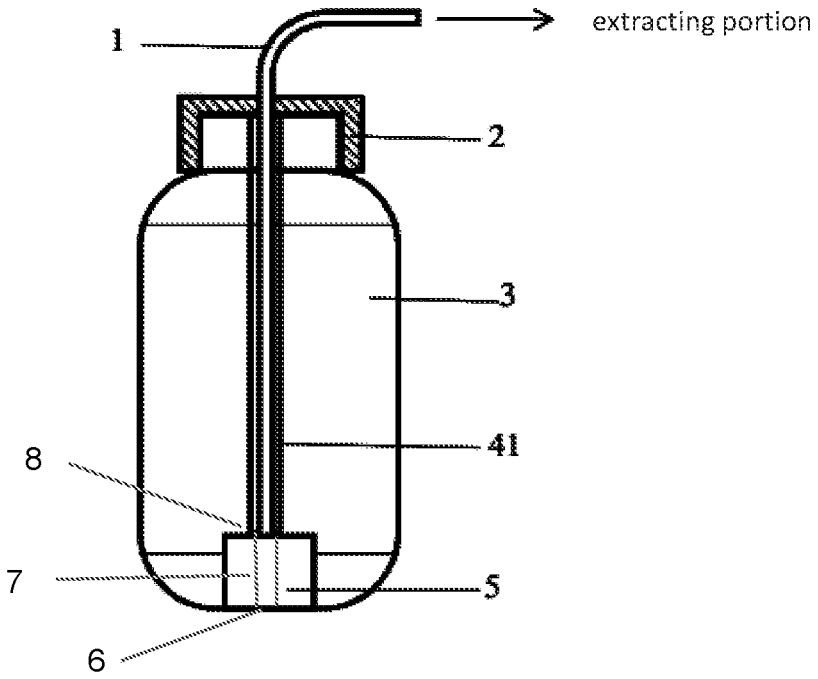
FIG. 2 is a configuration diagram of another embodiment of the present disclosure.

FIG. 2 is used to describe another embodiment of the present disclosure.

As shown in FIG. 2, in this embodiment, a tubular member 41 is used as an abutting member. Other members are the same as that described above, and description is omitted because same reference signs are used.

In this embodiment, the outer diameter of the tubular member 41 is larger than the diameter of the penetration hole on the container cover 2 and the diameter of the through hole 7 on the fixed block 5, the inner diameter of the tubular member 41 is larger than the outer diameter of the hose 1, and the hose 1 passes through the tubular member 41, and is connected to the fixing block 5. Similarly, one end of the tubular member 41 as the abutting member abuts against the container cover 2, and the other end abuts against the fixing block 5. In addition, an inward-recessed recess 8 may be formed on the surface of the fixing block 5 on which the tubular member 41 abuts, so that the tubular member 41 abuts against the recess 8. Furthermore, there is no particular limitation on the material constituting the tubular member 41, and the same material as that of the hose 1 can be selected for tubular member 41. When the liquid is corrosive, the tube member 41 is consequently to have corrosion resistance.

According to this embodiment, the fixing block 5 can be more reliably and simply abuted against the bottom of the container 3 through the tubular member 41, so that the liquid in the container 3 can be fully extracted.

In addition, according to the configuration of the present disclosure, the abutting member 4 or the tubular member 41 with sufficient length can be prepared in advance, and the abutting member 4 or the tubular member 41 with an appropriate length can be taken according to the distance between the container cover 2 and the fixing block 5. Therefore, the abutting member can be obtained simply and conveniently.

The embodiments of the present disclosure have been described above, but the embodiments are merely examples of description, and not intended to limit the scope of the invention. The embodiments can be implemented in various other forms, and various omissions, substitutions, changes, and combinations are made without departing from the scope of the invention. The embodiments and their variations are included within the scope and spirit of the invention, and also included in the scope of protection defined by claims and their equivalent technologies.

DESCRIPTION OF SYMBOLS

1 hose, 2 container cover, 3 container, 4 abutting member, 5 fixing block, 41 tubular member (abutting member)

What is claimed is:

1. A device for extracting liquid from a container, comprising:

an extracting unit configured to extract the liquid from the container, the container having a container cover;

a hose, one end of the hose being connected to the extracting unit through a penetration hole formed in the container cover;

a fixing block including a through hole, the through hole connected to the other end of the hose; and an abutting member, one end of the abutting member abutting against the container cover, the other end abutting against the fixing block, wherein the fixing block abuts against the inner bottom of the container with the through hole facing the inner bottom of the container, wherein the fixing block includes a communicating portion formed on its surface that is opposite to a surface to which the hose is connected, and the through hole of the fixing block is in communication with the fluid in the container through the communicating portion;

wherein the abutting member is a tubular member, the outer diameter of the tubular member is larger than a diameter of the penetration hole in the container cover and a diameter of the through hole in the fixing block, the inner diameter of the tubular member is larger than the outer diameter of the hose, and the hose is connected to the fixing block through the tubular member.

2. The device according to claim 1, wherein an inward-recessed recess is formed on a surface of the fixing block against which the tubular member abuts, and the tubular member abuts against the recess.

3. The device according to claim 1, wherein the hose, the fixing block, and the abutting member are made of a corrosion-resistant material.

4. The device according to claim 3, wherein the fixing block is made of one or more materials of polytetrafluoroethylene, polyetheretherketone, and polypropylene.

* * * * *